US005413447A

United States Patent [19]

Rathert

[11] Patent Number: 5,413,447

[45] Date of Patent: May 9, 1995

[54] COVER-FEEDING APPARATUS FOR A BOOK BINDING MACHINE

[75] Inventor: Horst Rathert, Minden, Germany

[73] Assignee: Kolbus GmbH & Co. KG, Rahden, Germany

[21] Appl. No.: 142,166

[22] Filed: Oct. 22, 1993

[30] Foreign Application Priority Data

Oct. 24, 1992 [DE] Germany ..... 42 36 033.1

[51] Int. Cl.[6] ..... B42C 11/04

[52] U.S. Cl. ..... 412/19; 412/4; 198/689.1

[58] Field of Search ..... 412/4, 11, 19; 198/380, 198/401, 689.1; 271/195

[56] References Cited

U.S. PATENT DOCUMENTS

| | | | |
|---|---|---|---|
| Re. 29,105 | 1/1977 | Miaskoff et al. | 412/11 X |
| 5,102,118 | 4/1992 | Vits | 271/195 |
| 5,232,324 | 8/1993 | Graushar | 412/4 |
| 5,261,769 | 11/1993 | Leclerc | 412/4 |

FOREIGN PATENT DOCUMENTS

| | | |
|---|---|---|
| 3139656 | 10/1981 | Germany . |
| 3340859 | 11/1983 | Germany . |
| 3819409 | 1/1989 | Germany . |

*Primary Examiner*—Tom Hughes
*Attorney, Agent, or Firm*—Chilton, Alix & Van Kirk

[57] ABSTRACT

In a book binding operation, opened covers are brought into alignment with moving book blocks by a feed system which applies a pneumatic hold-down force to the moving covers. This hold-down force provides for a braking effect which varies as a function of the characteristics of the cover, the braking effect minimizing the chances of overshoot. The hold-down force also provides a stiffening effect, in the direction of cover movement, which varies as a function of cover thickness and minimizes the possibility of crushing.

20 Claims, 1 Drawing Sheet

COVER-FEEDING APPARATUS FOR A BOOK BINDING MACHINE

BACKGROUND OF THE INVENTION

1. Field of the Invention

This invention relates to the delivery of covers into registration with moving book blocks during a book binding operation. More particularly the present invention is directed to cover-feeding apparatus for incorporation into a book binding machine and especially to apparatus for efficiently and gently bringing in-fed covers, which have been withdrawn from a magazine, into alignment with continuously moving book blocks. Accordingly, the general objects of the present invention are to provide novel and improved methods and apparatus of such character.

2. Description of the Prior Art

The present invention is intended for use with book binding machines of the type employing book block grippers which may be moved continuously on an endless path. In such book binding machines, a transport apparatus, located below the plane of movement of the spines of the book blocks which are to be fitted with covers, receives the covers as individually separated from a magazine. The received covers are moved by the transport apparatus to a position where they are acquired by an alignment mechanism which propels each cover into alignment with a moving book block. Both the cover transport and the alignment mechanism include pusher devices which engage and apply force to the covers. Support surfaces are provided for the covers which are transported in an opened condition. During the alignment operation, the in-fed over is brought into alignment with the rear edge of the moving book block. After this alignment is achieved, the cover will be affixed to the book block.

German Patent 31 39 656 discloses an exemplary prior art cover-feeding apparatus. In the apparatus of this German patent, in order to achieve the requisite extremely accurate positioning of the covers against the book blocks, use is made of a pusher-equipped transport apparatus which is driven at a speed which is lower than the speed at which the book block grippers move. The movement of the pushers which engage the covers is coordinated with that of the book block grippers such that, when the alignment operation begins, the rear or trailing edge of the cover is in front of, i.e., is leading, the trailing edge of the moving book block in the direction of movement of both the cover and block. The alignment mechanism includes aligning elements which resiliently engage the rear edge of the cover. These aligning elements travel on a continuous path with their motion being synchronized with the movement of the book block grippers. The aligning elements project beyond the rear edges of the book block grippers and, as a result of the above-mentioned speed differential, overtake the cover from behind and acquire it from the pushers. Upon acquisition by the aligning elements, due to the resilient bias, the covers are accelerated and caused to move into alignment with the moving blocks. During this positioning, sudden variations in cover speed occur. These sudden variations in speed precipitate the possibility of the cover shooting forwardly beyond the desired alignment position. Accordingly, it is common practice to employ resiliently biased arresting means which frictionally engage the cover and thus prevent undesired erratic forward motion. The arresting means may, for example, be in the form of spring elements which engage the outer edges of the oppositely disposed "pages" or "leaves" of the cover.

A problem of long-standing in the art, which is particularly prevalent if the covers are of thin construction, is cover distortion as a result of the braking forces applied to the outer edges thereof by the arresting means at the same time a propelling force is exerted in the center region of the cover by the aligning elements. That is, the combination of the retarding and propelling forces, respectivly directed to the side edges and trailing edge of the cover during the alignment operation, may lead to an unstable equilibrium condition which presents the risk of a pronounced crushing effect on the cover.

SUMMARY OF THE INVENTION

The present invention overcomes the above-briefly discussed and other deficiencies and disadvantages of the prior art providing a novel method for aligning covers with moving book blocks in a book binding operation. The present invention also encompasses an improved cover transport which is employed in the practice of this method.

Apparatus in accordance with the present invention has been devised for use with a book binding machine which has book block grippers. These grippers, which are caused to move continuously, support book blocks and move the thus supported blocks, typically held in a vertical orientation with the spines facing downwardly, along a path. The cover-feeding apparatus includes a transport which is installed below the book-block movement path. The cover transport includes means, for example one or more pusher elements, which infeed covers which have been separated individually from a magazine. The improved cover transport of the invention includes means for aligning the in-fed covers with the moving book blocks. This alignment means includes a pair of spaced apart, stationary cover support members which respectively receive and support portions of a in-fed cover on the opposite sides of the book block movement path. The alignment further comprises means, cooperating with the support members, for generating a pneumatic hold-down force for the covers. This hold-down force generating means has bearing surfaces which slope downwardly, and generally outwardly, with respect to the book block movement path. One of these bearing surfaces is disposed inwardly, toward the book block movement path, with respect to each of the support members. Each of these downwardly sloping bearing surfaces is provided with an array of orifices which define the discharge ends of nozzles. The nozzles have axes which are oriented such that a pressurized gas which passes through the nozzles will contact the underside of an in-coming cover and be deflected along the associated bearing surface, i.e., generally downwardly and outwardly with respect to the path of cover and book-block movement. The gas flowing along the bearing surfaces is discharged away from the covers in regions which are displaced inwardly toward the book block movement path with respect to the support members. The discharge of the gas creates a pressure differential, i.e., a suction effect, which produces the hold-down force. At the same time, the gas flow between the cover and the downwardly sloped bearing surfaces functions as a cushion, i.e., a pneumatic bearing, for the cover.

Apparatus in accordance with the invention enables covers to be aligned with extremely high accuracy while they are being positioned against the moving book blocks. The present invention also eliminates the risk of the covers being damaged, being crushed for example, because the above-mentioned pressure differential is applied to the covers in such a manner as to produce a longitudinal deformation which, in turn, provides an increase in stiffness in the transport direction. The cooperating pneumatic hold-down force and cushion provides a self-compensating effect in that a comparatively thin cover will be less forcefully braked but will be stiffened to a greater degree than a thicker cover.

BRIEF DESCRIPTION OF THE DRAWINGS

The present invention may be better understood and its numerous objects and advantages will become apparent to those skilled in the art by reference to the accompanying drawings wherein like reference numerals refer to like elements in the two figures and in which.

DESCRIPTION OF THE DISCLOSED EMBODIMENT

Figure 1:
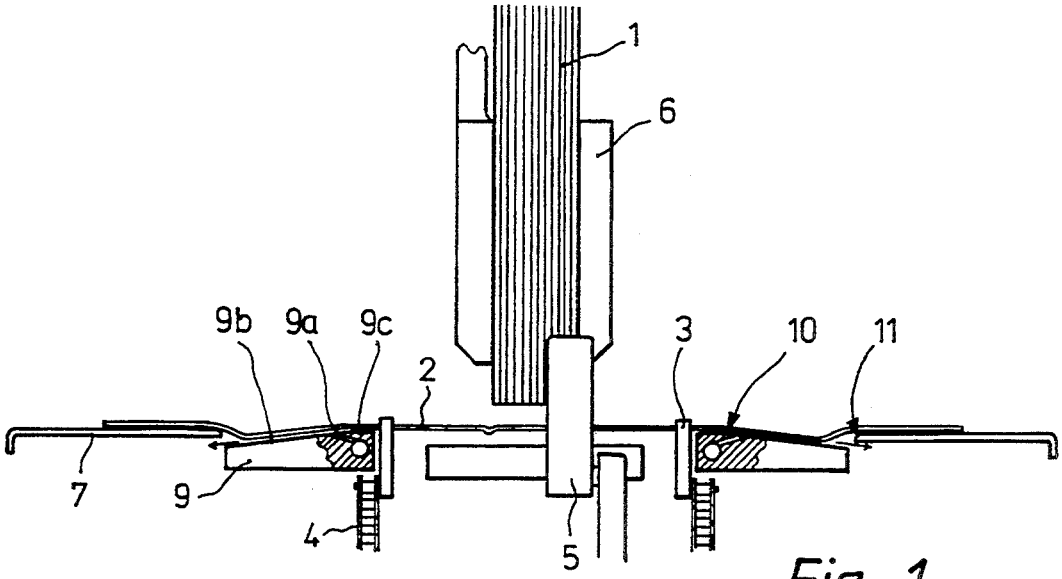
FIG. 1 is a front view, partly in section, of apparatus in accordance with a preferred embodiment of the present invention.

With reference now to the drawings, a book block which is to be fitted with a cover is indicated at 1. A cover, which is to be moved into alignment with and subsequently affixed to book block 1, is indicated at 2. The book block 1 is depicted as engaged by the jaws of a book block gripper 6. The gripper 6 is caused to move continuously and thus the lower end, i.e., the spine portion, of the moving book block 1 will define a planar book block transport path. The cover 2 will have been withdrawn from a magazine and transported into position where the alignment operation may be performed by means of pusher devices 3 which are driven by chains 4. The cover transport will, as shown, be installed below the book block movement path and the incoming covers, in response to the action of the pushers 3, will be arriving at a speed which is equal to or less than the speed of movement of the book block 1.

Figure 2:
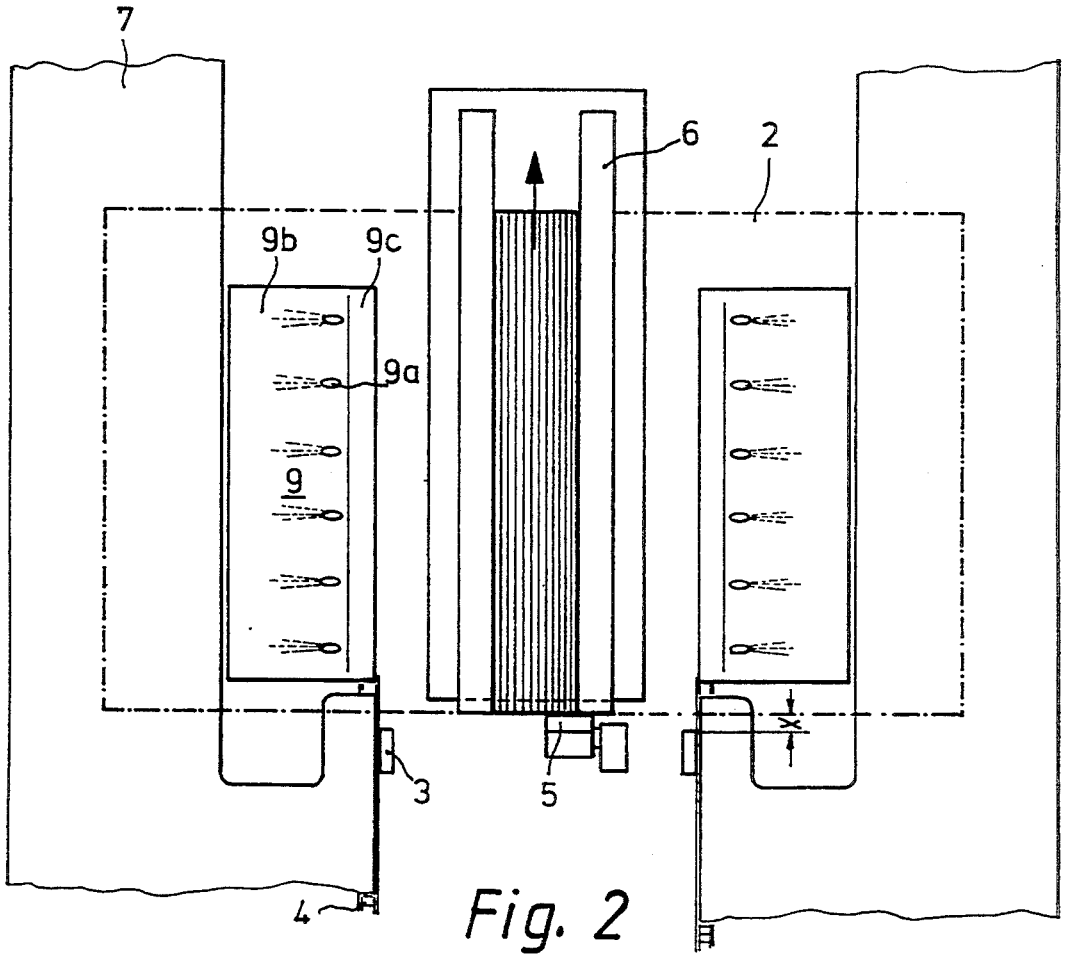
FIG. 2 is a top plan view of the apparatus of FIG. 1.

The incoming cover 2 will be acquired by a register finger 5 which is moving at a slightly higher speed than the cover, the register finger 5 having its own drive. The register finger 5 will cause the cover to be advanced by an amount which corresponds to the dimension "x"(see FIG. 2). The advancement of the cover 2 relative to the book block 1 will terminate when the register finger 5 contacts a stop which is in registration with the trailing end of the book block. In the disclosed embodiment, the book block gripper 6 functions as the stop for register finger 5.

The cover 2 is, during the alignment operation, supported in its lateral edge regions on a pair of skid plates 7. The cover engaging support surfaces of plates 7 are co-planar and are provided with lateral guides, not shown, which prevent skewing of the cover 2.

The skid plates 7 function as support members of the alignment apparatus of the present invention. This alignment apparatus further includes pneumatic guide means 9 which will hereinafter be referred to as "jet bodies". The jet bodies 9 are each provided with a bearing surface **9*b* which slopes transversely downward at a shallow angle. The jet bodies 9, and particularly the bearing surfaces 9*b* thereof, terminate at points which are disposed inwardly, with respect to the book block transport path, relative to an adjacent skid plate and at a point below the level of the plane defined by the skid plates. Thus, a discharge opening or gap, the purpose of which will be described below, is provided between the skid plates 7 and the bearing surfaces 9*b*. As may be seen from FIG. 2, the bearing surfaces 9*b* extend over essentially the entire height of the cover 2 in the direction of cover travel. The jet bodies 9 each define an array of "nozzles" 9*a* which are provided with discharge ends, i.e., outlet orifices, in bearing surfaces 9*b*. The nozzles 9*a* have axes which are directed upwardly at a shallow angle with respect to a horizontal plane parallel the plane defined by skid plates 7. As may be seen from FIG. 2, the outlet orifices of nozzles 9*a* are arranged in a linear array in each of bearing surfaces 9*b*. These arrays extend the length of the bearing surfaces. Compressed air, or other pressurized gas, will be delivered to a plenum, to which each of the nozzles 9*a* is coupled, by means of a pressure regulator, not shown. Pressurized gas flowing through the nozzles 9*a* will be deflected by a cover 2 so as to flow downwardly along the bearing surfaces 9*a* as indicated by the arrows on FIG. 1, the gas being discharged via the gaps between the bearing surfaces 9*a* and the skid plates 7. This gas flow serves two functions. Firstly, the gas flow defines an air cushion or bearing between the cover 2 and the bearing surfaces 9*a*. Secondly, and most importantly, the flow of gas outwardly through the gap between the bearing surfaces and skid plates creates suction, i.e., a pressure differential is established, which distorts the cover downwardly as shown in FIG. 1**.

Because of the above-mentioned air cushion, there will be essentially no friction between cover 2 and surfaces **9*b* of the jet bodies 9. However, variable friction will occur in the linear regions, indicated generally at 10 and 11 in FIG. 1, where bending of the cover occurs or tends to occur due to the pneumatic force resulting from the above-discussed pressure differential. The amount of this friction is directly related to the stiffness of the cover 2. That is, the amount of friction, and thus the braking force which opposes forward movement of the cover, is inversely related to the degree to which the moving cover conforms to the shape of the sloped bearing surfaces 9*b*. Accordingly, a frictional force which is a function of the stiffness of the cover material, this frictional force holding the cover back against the register finger 5**, is generated.

As noted, the above-discussed pressure differential created, pneumatic force gives rise to a longitudinal deformation of the cove. That longitudinal deformation, in turn, causes an increase in the stiffness of the cover in the transport direction in the manner of a corrugation. Thus, while a cover 2 consisting of a thin material will be braked less powerfully, since there will be less friction between the thin cover and the surfaces on which it is supported, the thin cover will at the same time will be stiffened to a greater degree when compared to a thicker and thus more strongly braked cover. This self-regulatory effect enables extremely accurate alignment to be achieved without the risk of damage to the cover through crushing.

In the operation of the present invention, the braking forces applied to the cover act in a region close to where the pushing force is applied. Also, the stiffening effect occurs in the region where the braking force occurs, namely in the region between each of the lateral supporting surface 7 and the inside-located planar supporting surfaces 9*c* formed on the adjacent jet body 9. The inside supporting surfaces 9*c* of the jet bodies are preferably co-planar with the support surfaces of the skid plates 7.

As a result of the holding-down of the cover 2 by means of a pneumatic force, i.e., through the agency of a flowing gas, the pushers 3 will reliably engage and push cover 2 forwardly prior to the acquisition thereof by the register finger 5. As an added advantage of the present invention, a desirable lateral stretching effect of the cover is achieved through the agency of the outwardly-directed gas flow.

As noted above, the gas flow may be adjusted to suit the cover material and feed speed conditions by means of a pressure regulator.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. In apparatus for establishing alignment between a moving book block and a book cover, said apparatus having grippers which move a book block along a path, said apparatus further having a cover transport which is located below the book block movement path, the cover transport including at least first pusher means for imparting movement to individual covers which have been withdrawn from a magazine, the improvement comprising a pair of stationary lateral support members which respectively receive and support portions of a cover on the opposite sides of said book block path, said support members cooperating to define a planar transport path for the cover, means for generating a pneumatic hold-down force for a cover supported by said lateral support members, said hold-down force generating means each having a bearing surface which slopes downwardly and generally outwardly with respect to said planar path, each of said bearing surfaces being provided with the discharge ends of a plurality of nozzles, said nozzles having axes which are directed upwardly at a shallow angle whereby pressurized gas delivered to said nozzles will pass through said discharge ends and will impinge on a cover supported on said support members and be deflected along a said bearing surface, gas flowing along said bearing surfaces being discharged away from said cover at regions displaced inwardly with respect to said support members to thereby provide a pressure differential which produces the hold-down force.

2. The apparatus of claim 1 wherein the book covers have a central portion which is to be registered with the spine of a book block and wherein each of said bearing surfaces is disposed inwardly toward a said cover central portion with respect to said cover support member.

3. The apparatus of claim 2 wherein the gas flow along said bearing surfaces defines pneumatic bearings for the covers.

4. The apparatus of claim 2 wherein said support members have planar cover engaging surfaces and said regions where gas is discharged are disposed below the plane of an adjacent support member whereby the covers are deflected downwardly by said hold-down force in said gas discharge regions.

5. The apparatus of claim 4 wherein said hold-down force generating means further includes generally planar bearing surfaces disposed between said sloped bearing surfaces and said book block path, said planar bearing surfaces being generally coplanar with said cover transport path.

6. Thee apparatus of claim 5 wherein the covers have a height measured in the direction of movement thereof and wherein said downwardly sloped bearing surfaces extend over substantially the entire height, in the direction of movement thereof, of the covers.

7. The apparatus of claim 6 wherein said nozzles in each of said bearing surfaces are linearly arranged in a row which extends in the direction of movement of the covers.

8. The apparatus of claim 7 wherein the gas flow along said bearing surfaces defines pneumatic bearings for the covers.

9. The apparatus of claim 4 wherein the covers have a height measured in the direction of movement thereof and wherein said downwardly sloped bearing surfaces extend over substantially the entire height, in the direction of movement thereof, of the covers.

10. The apparatus of claim 9 wherein said nozzles in each of said bearing surfaces are linearly arranged in a row which extends in the direction of movement of the covers.

11. The apparatus of claim 2 wherein said hold-down force generating means further includes generally planar bearing surfaces disposed between said sloped bearing surfaces and said book block path, said planar bearing surfaces being generally coplanar with said cover transport path.

12. The apparatus of claim 11 wherein the covers have a height measured in the direction of movement thereof and wherein said downwardly sloped bearing surfaces extend over substantially the entire height, in the direction of movement thereof, of the covers.

13. The apparatus of claim 2 wherein the covers have a height measured in the direction of movement thereof and wherein said downwardly sloped bearing surfaces extend over substantially the entire height, in the direction of movement thereof, of the covers.

14. The apparatus of claim 1 wherein said hold-down force generating means further includes generally planar bearing surfaces disposed between said sloped bearing surfaces and said book block path, said planar bearing surfaces being generally coplanar with said cover transport path.

15. The apparatus of claim 14 wherein the covers have a height measured in the direction of movement thereof and wherein said downwardly sloped bearing surfaces extend over substantially the entire height, in the direction of movement thereof, of the covers.

16. The apparatus of claim 15 wherein said nozzles in each of said bearing surfaces are linearly arranged in a row which extends in the direction of movement of the covers.

17. The apparatus of claim 1 wherein the covers have a height measured in the direction of movement thereof and wherein said downwardly sloped bearing surfaces extend over substantially the entire height, in the direction of movement thereof, of the covers.

18. The apparatus of claim 17 wherein said nozzles in each of said bearing surfaces are linearly arranged in a row which extends in the direction of movement of the covers.

19. The apparatus of claim 1 wherein said nozzles in each of said bearing surfaces are linearly arranged in a row which extends in the direction of movement of the covers.

20. The apparatus of claim 1 further comprising means for controlling the gas delivered to said nozzles.

* * * * *